US007715749B2

(12) United States Patent
Dangelmaier et al.

(10) Patent No.: US 7,715,749 B2
(45) Date of Patent: May 11, 2010

(54) CHARGE COROTRON AUTO-CLEANER DEVICE

(75) Inventors: Bruce A. Dangelmaier, West Henrietta, NY (US); David L. Keefe, Cato, NY (US); Martin J. Curynski, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 841 days.

(21) Appl. No.: 11/521,055

(22) Filed: Sep. 14, 2006

(65) Prior Publication Data

US 2008/0069586 A1 Mar. 20, 2008

(51) Int. Cl.
*G03G 15/02* (2006.01)

(52) U.S. Cl. ..... 399/100; 399/115

(58) Field of Classification Search ..... 399/100, 399/115

See application file for complete search history.

(56) References Cited

U.S. PATENT DOCUMENTS 4,256,399 A * 3/1981 Ikeda ..... 399/210
4,864,363 A * 9/1989 Shinada ..... 355/133
5,079,963 A * 1/1992 Yamamoto et al. ..... 74/424.75
5,485,255 A * 1/1996 Reuschle et al. ..... 399/168
6,091,917 A * 7/2000 Aoki ..... 399/115
6,415,120 B1 * 7/2002 Tashiro et al. ..... 399/100
7,272,337 B2 * 9/2007 Owens ..... 399/100
7,623,806 B2 * 11/2009 Tanase ..... 399/100
2002/0118979 A1 * 8/2002 Walgrove et al. ..... 399/100
2008/0260417 A1 * 10/2008 Hotani ..... 399/100

FOREIGN PATENT DOCUMENTS

JP 05281839 A * 10/1993
JP 07271156 A * 10/1995
JP 2003015388 A * 1/2003
JP 2005241945 A * 9/2005
JP 2007114293 A * 5/2007
JP 2008170832 A * 7/2008

* cited by examiner

*Primary Examiner*—David M Gray
*Assistant Examiner*—Geoffrey T Evans
(74) *Attorney, Agent, or Firm*—James J. Ralabate

(57) ABSTRACT

High torque causing machine failures and motor damage are corrected by the embodiments of this invention. Springs are put on both ends of the lead shaft and the windings around the lead shaft are reduced to substantially reduce the torque created during a power on-power off situation in addition to during normal operations.

11 Claims, 5 Drawing Sheets

CHARGE COROTRON AUTO-CLEANER DEVICE

The presently disclosed embodiments are directed generally to an electrostatic marking device both monochrome and color and, more specifically, to the corona-charging portion of these electrostatic copiers.

BACKGROUND

When photocopiers were first used, charging of the photoreceptor or photoconductive surface was usually accomplished by rubbing the photoconductive surface with electronic charging materials such as rabbit fur. Today, much more sophisticated charging means are used, in particular, corona charging devices such as corotrons, scorotrons, etc. Generally, the corona charger comprises a charge-emitting wire or an array of charge-emitting pins located in close proximity to a corona grid. The pins emit the charge and convey this charge to a conductive grid, which provides uniformity of charge across the entire used surface of the photoreceptor. The grid is specifically configured so as to have uniform charge-emitting capabilities across its entire longitudinal surface. It is especially important to maintain the grid surface and wire in condition where they will provide this uniform charge distribution across the photoreceptor or photoconductive surface. Once a uniform charge is placed by the grid across the photoreceptor surface, the remainder of the imaging process is followed, i.e. exposure of image, dissipation of charge in image configuration, contact with toner and fixing of toner image on a paper or receptive surface.

Contamination of the pins, wire, or inner and outer sides of the grid could lead to print quality defects, such as streaks, image quality defects and other performance problems. Examples of image quality failures would be half tone non-uniformities and white and dark streaks in the final image. Also, the life of the corona-charging mechanism can be adversely affected if the wire and grid are not kept uniformly clear of contaminants such as dust and toner.

There are used today various automatic corona-cleaning methods and apparatus to remove the toner build up and other contaminates from the wire and grid. Traditionally, these corona-cleaning devices have focused on cleaning the pins, wires and surface of the corona grid. Usually, in these automatic cleaners, a brush is used to clean the grid while a pad located below the brush is used to clean the pins or the corona wire. They move together when the shaft and brush-pad holder are moved. A winding on a lead shaft is used to project the brush and pad holder along the longitudinal plan of the wire and grid.

Currently, the existing charge scorotron assembly cleaner has design flaws that cause high torque conditions which, in turn, cause field issues, especially during power on, power off (POPO) conditions or paper jamming. A current prior art design enables the machines to cycle the above scorotron cleaner every 1000-1500 copies to clean the grid, pins and charge scorotron wire. However, if and when a paper jam or power off condition occurs, the machine is "dumb" and does not have a sensor or have the capability to tell where in position the cleaner assembly is when machine is ready then for printing. Thus, the machine automatically instructs the auto clean device to turn on for 33 seconds to complete one cycle (back and forth). If the auto clean device is moved away from the home position, i.e. cleaning when jammed, the machine does not know this and still cycles the auto-cleaner for 33 seconds. Currently, there is a high torque issue with this prior art system and device with the added cycle time due to jamming or other issues. This will, most likely, eventually overstress the system causing breakage of the motor gears and cause the machine to fault. This equals customer dissatisfaction and expensive repairs.

The present embodiments of this invention will solve this potential quality repair and customer dissatisfaction issue. In addition, in one embodiment making the device and shaft of this invention by plastic injection molding rather than metal will save a considerable amount of money; over 20% of previous costs. This amount is based on current projections but may, in fact, exceed this projection.

SUMMARY

The present embodiments provide a major modification of these corona auto-cleaning devices and Xerographic cartridges to solve the above-noted issues concerning high torque and breakage of motor gears. In addition, this invention reduces the cost of the print cartridge and prevents or minimizes the requirements to change or repair the motor because of these above noted prior art problems. The rod-like lead shaft on prior art auto cleaners has sinuous windings along its entire length. These windings are used to move the brush-pad holder along the length of the grid and the brush-pad holder along the length of the pins or corona wire. These windings, because of their length, cause in part the torque problems above addressed since they are along the total length of the shaft. In an embodiment of this invention, these windings are reduced in length by from 2-10%. By the term "reduced length" used throughout this disclosure and claims means a reduction of 2-10% from prior art windings. This reduction solves the torque problem because it eliminates the movement before the end of the shaft. In addition to shortening the windings, two springs are located at each terminal portion of the lead shaft. This provides the engagement of the holder 6 to the windings when motor is reversed. Thus, the present embodiments provide an auto-cleaning system devoid of the prior art torque and motor problems by using a lead shaft with shorter windings and by providing two springs at each end of the lead shaft.

The above describes a drive shaft and mechanism for a scorotron grid cleaner. As earlier noted, certain situations in the prior art drive mechanism can result in a high torque condition on the motor (particularly at the end of travel of the cleaning mechanism). This can lead to failure of gears in the drive train. The present invention provides a spring mechanism and shortened drive portion of the shaft. This allows the shaft to spin freely at its end of travel relieving the high torque situation. Upon reversal of the drive shaft, the spring pushes the cleaning mechanism back to re-engage the drive portion of the shaft. The current prior art metal drive shaft is also replaced with a plastic shaft for a substantial cost savings.

DETAILED DISCUSSION OF DRAWINGS AND PREFERRED EMBODIMENTS

Figure 1:
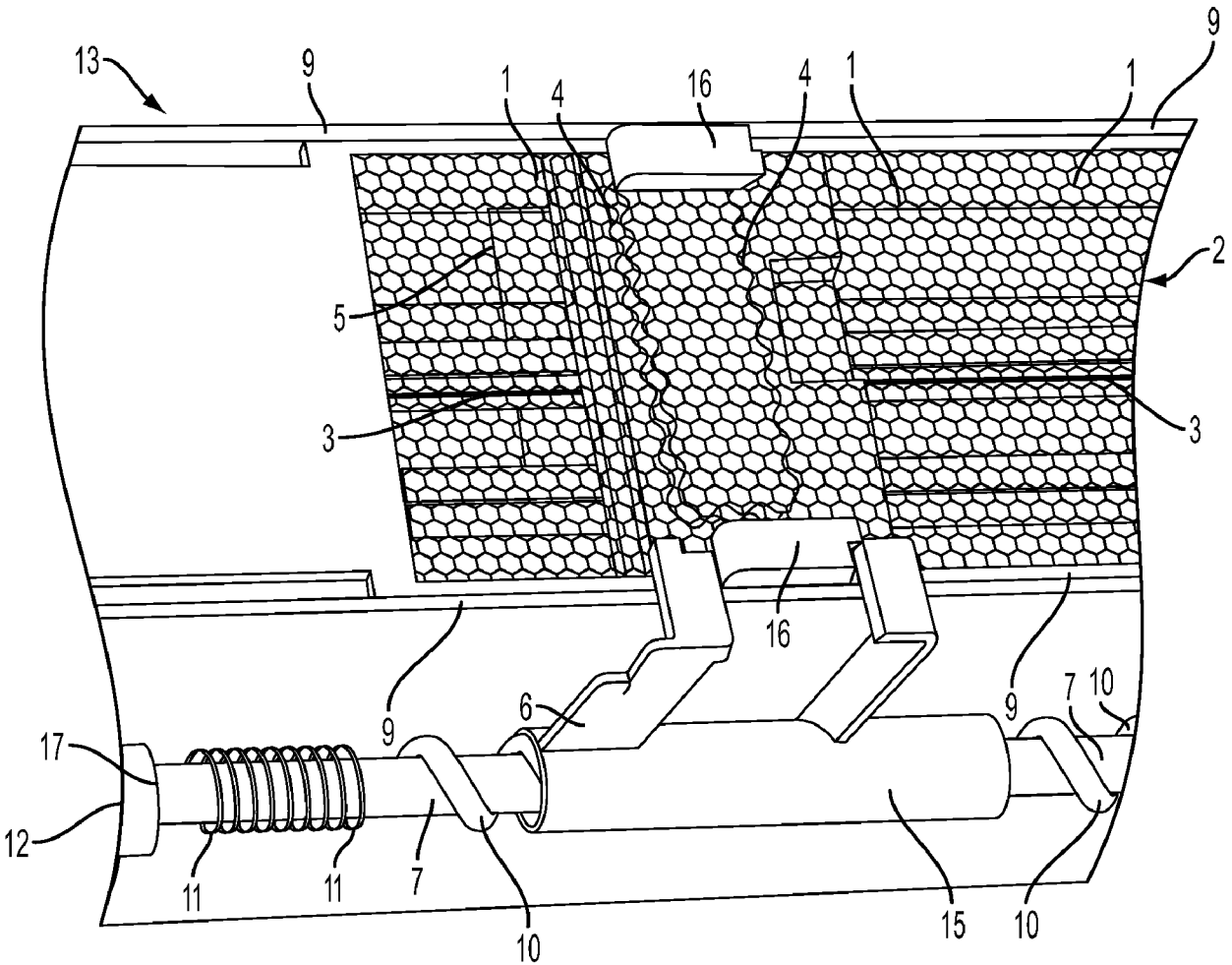
FIG. 1 is a perspective view of an embodiment of an auto-cleaning device of this invention with a grid and corona wire cleaner.

In FIG. 1, a grid and corona wire (or pins in FIG. 2) is illustrated having a grid 1 with an inner surface 2 and a corona wire 3, both of which extend beneath grid 1. Also below grid 1 is a grid cleaner brush 4 which when moved horizontally along the length of grid 1 cleans the grid 1. Below the cleaner brush 4 is a corona wire-cleaning pad 5 which is moved together with brush-pad holder 6 along the entire length of corona wire 3. Both brush 4 and pad 5 are operatively connected to holder 6 so that when holder 6 is moved, so are pad 5 and brush 4 moved. A transport device or helix 7 when turned imparts motion to the holder 6, pad 5 and brush 4 and causes the brush 4 and pad 5 to contact and clean the grid 1 and corona wire 3 respectively. Below the grid 1 are positioned a corona wire 3 in one embodiment or an array of charge-emitting pins 8 (see FIG. 2). The holder 6 is operatively movably connected to rails 9 where they are slidably movable upon motion imparted by the transport lead shaft or helix 7. Lead shaft 7 is driven by a suitable source of power or a motor (not shown). The windings 10 around lead shaft 7 are reduced 2-10% from those in standard prior art lead shafts. This reduction reduces the torque encountered in prior art devices of this nature by eliminating future movement of the holder 6. A spring 11 is placed on both ends 12 of the lead shaft 7. These springs 11 together with the reduced windings will allow lead shaft 7 to spin freely.

The embodiment of FIG. 1 shows brush 4 and pad 5 offset from each other, however, they can be superimposed, if desirable, one completely below the other. The grid-cleaning brush 4 and wire-cleaning pad 5 can be made of a woven fiber or foam material or any other suitable material.

FIG. 1, for clarity, shows only one end of the assembly 13. However, the opposite end of assembly 13 is similar to the end shown in FIG. 1, with springs 11 at both ends.

Figure 2:
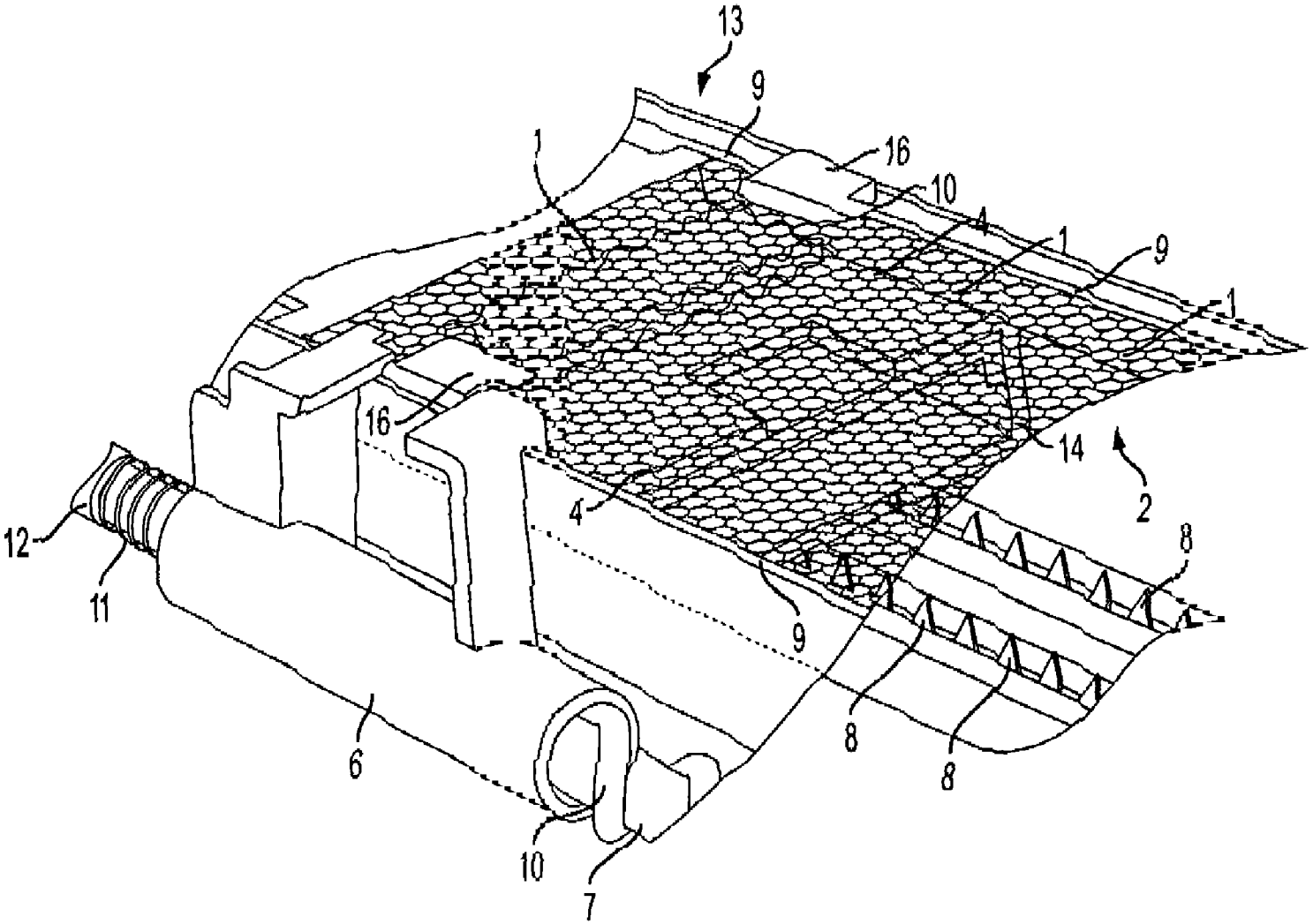
FIG. 2 is a perspective view of an embodiment of an auto-cleaning device of this invention with a grid and charge-emitting pins.

In FIG. 2, the same configuration as in FIG. 1 is used except rather than using a corona wire 3, charge-emitting pins 8 are used. Also, rather than a wire-cleaning pad 5 (as in FIG. 1), a pin-cleaning component 14 is used. A grid-cleaning brush 4 as in FIG. 1 is used also in FIG. 2.

Figure 3:
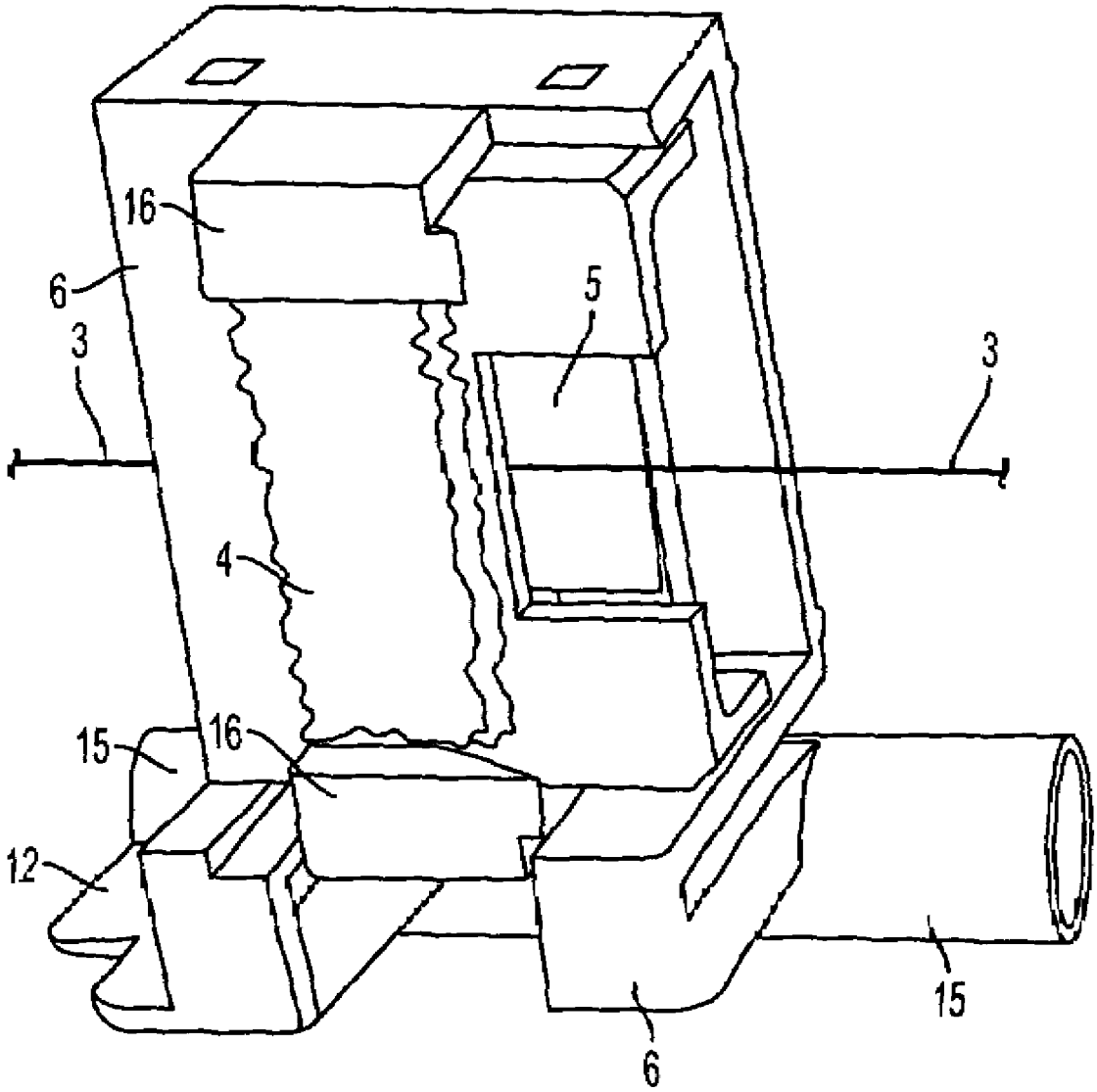
FIG. 3 illustrates a close-up of an embodiment of brush-pad holder used in this invention.

In FIG. 3 a brush pad holder 6 is illustrated as it is removed from the assembly 13 of this invention. Holder 6 comprises a bottom tubular section 15, which includes helix lead shaft 7 when the assembly 13 is in use. The slides 16 fit over rails 9 as the assembly 13 moves back and forth. A cleaner brush 4 is located at a top portion of the holder 6; this brush 6 cleans grid 1 when the holder is moved through the length of the brush 4 and corona wire 3 (or a cleaner component 14 to clean the pins 8). The lead shaft 7 fits through tubular section 15 in order to remove holder 6 back and forth. At one end 12 of tubular section 15 will be positioned springs 11, which encircle shaft 1 and abut end 12. As shown in FIG. 3 corona wire 3 slides over and in contact with cleaner pad 5. The inner section of tube 15 is configured so as to be moved as lead shaft 7 is rotated.

Figure 4:
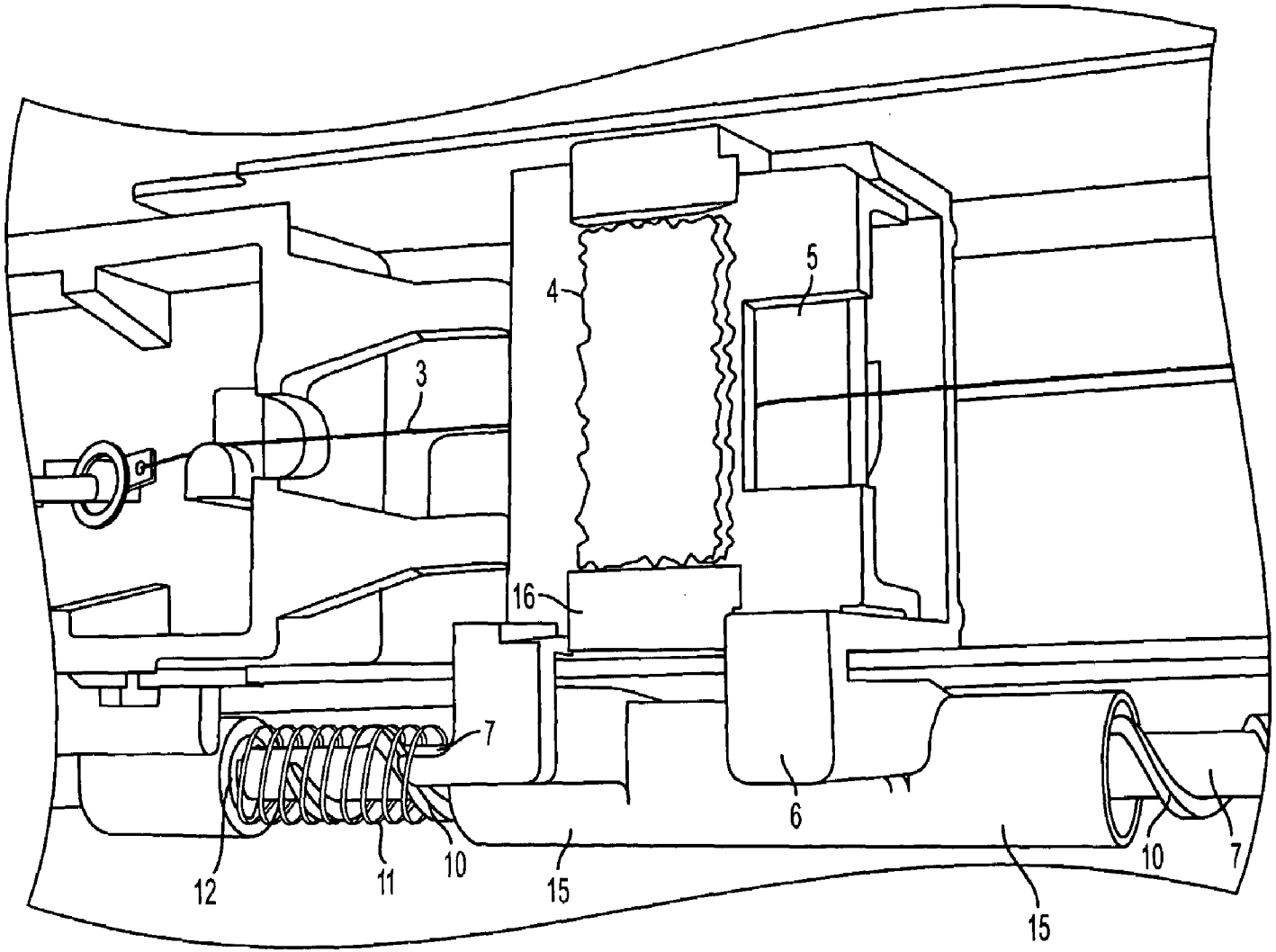
FIG. 4 illustrates a top view (with grid removed) of an embodiment of an assembly of this invention.

In FIG. 4 a top end view of assembly 13 is illustrated with grid 1 removed for clarity. Here holder 6 is in movable position with tubular section 15; encircling shaft 7 corona wire 3 is shown as it contacts cleaning pad 5, which is located below grid brush cleaner 4. Springs 11 are shown in position in contact with ends 12 of lead shaft 7. Springs 11 encircle lead shaft 7 and prevent the tube 15 of holder 6 from contacting assembly end 17. Brush 4 is enabled to clean grid 1, and pad 5 is enabled to clean corona wire 3 (or pin-cleaning components 14 will clean pins 8 as shown in FIG. 2).

Figure 5:
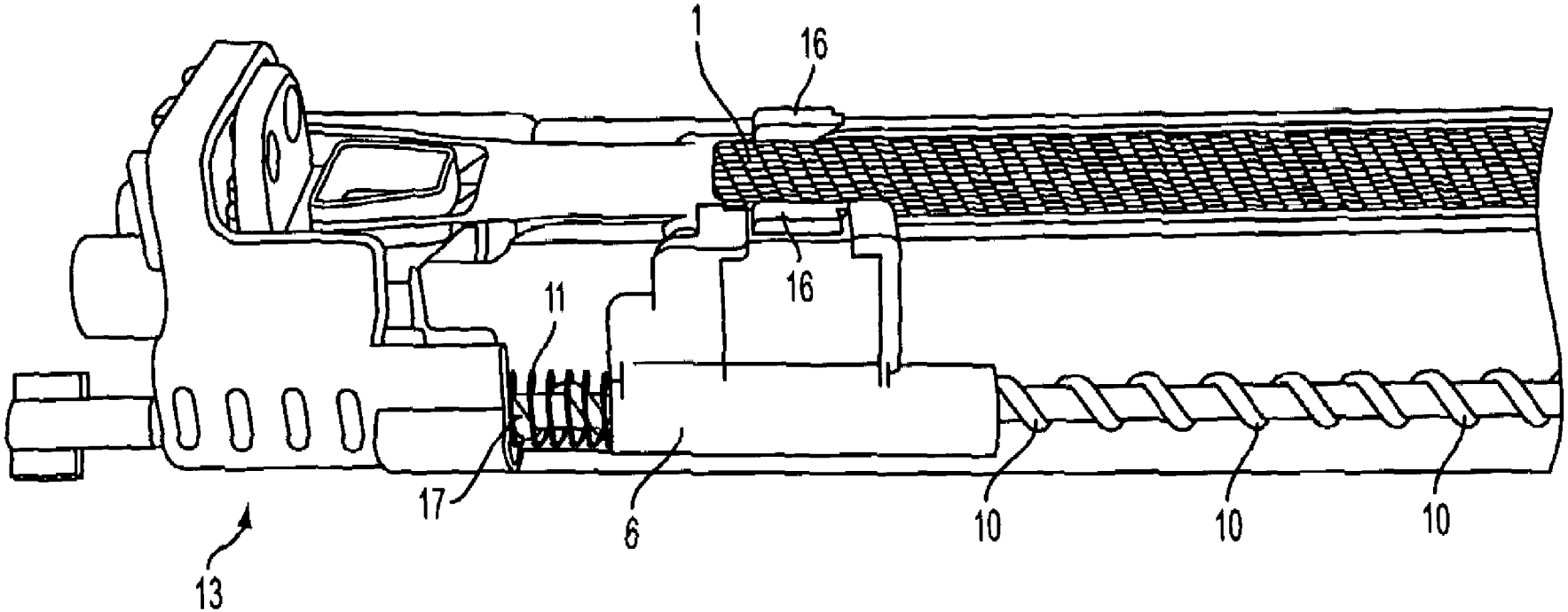
FIG. 5 illustrates a side view of an embodiment of the assembly of this invention.

In FIG. 5 a side perspective view of an assembly 13 end is shown. This end is the same as an opposite end of assembly 13 (not shown for clarity). Here grid 1 is shown in position as it is used and cleaned during the operation of an electrostatic marking system. Assembly 13 is used as an automatic grid 1, wire 3, pin 8 cleaner during intervals of about 1,000 copies or passes. Note that the windings 10 are much further apart than in previously used lead shafts of prior art. Also spring 11 prevents holder 6 from hitting assembly end 17 and reduces the torque (together with reduced windings 11). This prevents major damage to the motor used to move or impede holder 6 across the assembly 13 and grid 1 and corona wire 3.

The springs 11 located at end 12 of the lead shaft 7 and the shortened or reduced windings 10 prevent high torque causing assembly failures in the motors (not shown) of marking machines during power on-power off and during normal operations.

Fundamentally, embodiments of this invention provide an assembly for cleaning a corona-generating device which comprises in an operative arrangement, a lead shaft, a component for driving the lead shaft, and a movable brush-pad holder. The holder is enabled to move a cleaner pad and a cleaner brush to clean along a length of a corona wire and a corona grid. The lead shaft has reduced windings and a spring at each of its terminal ends. As noted earlier, the combination of reduced windings and the springs substantially reduces torque and damage to the motor that powers this assembly. The windings are reduced 2-10% from prior art windings which makes them shorter than in the prior art.

The springs are enabled to be in operative contact with an end of the holder when the assembly is in use. The brush is enabled to clean the grid and the pad is enabled to clean the corona wire. In place of a corona wire, charge-emitting pins can be used. If pins are used, a pin-cleaning component is used as shown in FIG. 2. The brush is positioned above the pad or pin-cleaning component. The holder is enabled to be moved by the lead shaft, the lead shaft has a rod-like helix configuration and the holder has a tubular portion which encircles the lead shaft and is in a movable relationship with the windings. The holder and the lead shaft are moved hands-free by a power source attached to the shaft.

Embodiments of this corona grid-cleaning assembly comprise, in an operative relationship, at least one brush cleaner, at least one pin cleaner or cleaner pad, a corona grid, a corona wire or array of charge-emitting pins, an automatic hands-free transport system and a brush-pad holder. The transport system comprises a lead shaft attached to a source of power. The lead shaft has windings there around which contact the holder and move the holder along a length of the assembly. The lead shaft has reduced windings and has springs at each of its terminal portions through which the lead shaft extends. The springs when in use are in operative contact with a terminal portion of the holder. The windings are reduced 2-10% from standard prior art windings and the springs are located at terminal portions of the lead shaft and in operative contact with terminal portions of the holder when the assembly is in use; the lead shaft is in the form of a helix. In this assembly, the brush is enabled to clean the grid, the pad is enabled to clean the corona wire and the pin-cleaning component is enabled to clean the charge-emitting pins. The holder is enabled to be moved by the lead shaft, the lead shaft has a rod-like helix configuration. The holder has a tubular portion which encircles and is connected to the lead shaft and is in a movable relationship with the windings. The holder supports the brush in its upper position and the component and the pad in a lower position. The reduced windings and the springs are enabled to provide less torque and stress in the assembly and minimize motor damage. The lead shaft and the holder are enabled to move the brush, the pin-cleaning component and the pad at substantially the same time across substantially the entire inner surface of the grid and the entire length of the corona wire or array of pins.

While particular embodiments have been described, alternatives, modifications, variations, improvements, and substantial equivalents that are, or, may be presently unforeseen, may arise to applicants or others skilled in the art. Accordingly, the appended claims as filed and as they may be amended are intended to embrace all such alternatives, modifications, variations, improvements and substantial equivalents.

What is claimed is:

1. A corona grid-cleaning assembly which comprises, in an operative relationship:

at least one brush cleaner, at least one cleaner pad, a corona grid, a corona wire, an automatic hands-free transport system comprising a lead shaft attached to a source of power, said lead shaft having windings there around which contact a holder and move said holder along a length of said corona grid-cleaning assembly, said holder having at its lower portion a tubular section and configured to support said brush cleaner and said cleaner pad, said lead shaft having terminal portions and windings which do not extend along an entire length of the lead shaft, and having springs at each of its terminal portions through which said lead shaft extends, said springs when in use are in operative contact with a terminal portion of said holder, said springs configured to prevent said holder from contacting an end portion of said assembly, and wherein said windings extend along all but 2-10% of a length of said lead shaft.

2. The corona grid-cleaning assembly of claim 1 wherein said brush cleaner is configured to clean said corona grid and said cleaner pad is configured to clean said corona wire.

3. The corona grid-cleaning assembly of claim 1 wherein said holder supports said brush cleaner in an upper position and said cleaner pad in a lower position, said windings and said springs are configured to minimize torque and stress in a motor connected to said corona grid-cleaning assembly.

4. The corona grid-cleaning assembly of claim 1 wherein said lead shaft and said holder are enabled to move said brush cleaner and said cleaner pad at substantially the same time across substantially the entire inner surface of said corona grid and the entire length of said corona wire.

5. The corona grid-cleaning assembly of claim 1 wherein said transport system comprises a movable helix which imparts lateral movement to said holder across substantially the length of said corona grid-cleaning assembly.

6. A corona grid-cleaning assembly which comprises, in an operative relationship:

at least one brush cleaner, at least one cleaner pad, a corona grid, a corona wire, an automatic hands-free transport system, and a brush-pad holder, said transport system comprising a lead shaft attached to a source of power, said lead shaft having windings there around which contact said brush-pad holder and move said brush-pad holder along a length of said corona grid-cleaning assembly, said holder configured to support said brush cleaner and said cleaner pad and having a tubular configuration at a lower portion, said lead shaft having terminal portions and windings which do not extend along an entire length of the lead shaft and having springs at each of its terminal portions through which said lead shaft extends, said springs when in use are in operative contact with a terminal portion of said brush-pad holder, said windings extend along all but 2-10% of a length of the lead shaft, and wherein said springs are located at terminal portions of said lead shaft and in cooperative contact with terminal portions of said brush-pad holder when said corona grid-cleaning assembly is in use, said lead shaft in the form of a helix, said springs configured to prevent said holder from contacting an end portion of said assembly.

7. The corona grid-cleaning assembly of claim 6 wherein said brush cleaner is enabled to clean said corona grid and said cleaner pad is enabled to clean said corona wire.

8. The corona grid-cleaning assembly of claim 6 wherein said brush pad holder is enabled to be moved by said lead shaft, said lead shaft having a rod-like helix configuration, said brush-pad holder having a tubular portion which encircles said lead shaft and is in a movable relationship with said windings.

9. The corona grid-cleaning assembly of claim 6 wherein said brush-pad holder and said lead shaft are moved hands-free by a power source attached to said lead shaft.

10. The corona grid-cleaning assembly of claim 6 wherein said brush-pad holder supports said brush cleaner in an upper position and said cleaner pad in a lower position, said windings and said springs are configured to avoid torque and stress in a motor in said corona grid-cleaning assembly.

11. The corona grid-cleaning assembly of claim 6 wherein said lead shaft and said brush-pad holder are enabled to move said brush cleaner and said cleaner pad at substantially the same time across substantially the entire inner surface of said corona grid and the entire length of said corona wire.

* * * * *